US006356829B1

(12) United States Patent
Fan et al.

(10) Patent No.: US 6,356,829 B1
(45) Date of Patent: Mar. 12, 2002

(54) UNIFIED CONTROL OF A WORK IMPLEMENT

(75) Inventors: Zhejun Fan, Woodridge; Alan D. Berger, Winfield, both of IL (US)

(73) Assignee: Case Corporation, Racine, WI (US)

( * ) Notice: Subject to any disclaimer, the term of this patent is extended or adjusted under 35 U.S.C. 154(b) by 0 days.

(21) Appl. No.: 09/365,972

(22) Filed: Aug. 2, 1999

(51) Int. Cl.[7] ..... F15B 13/16

(52) U.S. Cl. ..... 701/50; 37/416; 414/699; 901/9; 901/16

(58) Field of Search ..... 701/50, 36, 51; 37/348, 416, 443; 91/361; 414/699; 901/9, 15, 16

(56) References Cited

U.S. PATENT DOCUMENTS

| | | | | |
|---|---|---|---|---|
| 5,356,259 A | | 10/1994 | Hanamoto et al. | 414/614 |
| 5,392,539 A | | 2/1995 | Hirata et al. | 37/348 |
| 5,430,643 A | | 7/1995 | Seraji | 364/167.01 |
| 5,442,868 A | | 8/1995 | Ahn | 37/348 |
| 5,446,980 A | | 9/1995 | Rocke | 37/348 |
| 5,493,798 A | | 2/1996 | Rocke et al. | 37/348 |
| 5,499,320 A | | 3/1996 | Backes et al. | 395/95 |
| 5,513,100 A | | 4/1996 | Parker et al. | 364/167.01 |
| 5,535,532 A | | 7/1996 | Fujii et al. | 37/348 |
| 5,559,725 A | | 9/1996 | Nielson et al. | 364/550 |
| 5,648,709 A | | 7/1997 | Maeda | 318/568.17 |
| 5,699,247 A | | 12/1997 | Moriya et al. | 364/424.07 |
| 5,701,793 A | * | 12/1997 | Gardner et al. | 91/361 |
| 5,704,429 A | | 1/1998 | Lee et al. | 172/4.5 |
| 5,737,500 A | | 4/1998 | Seraji et al. | 395/86 |
| 5,752,333 A | | 5/1998 | Nakagawa et al. | 37/348 |

OTHER PUBLICATIONS

Configuration Control of Redundant Manipulators: Theory and Implementation, Homayoun Seraji, Senior Member, IEEE, ©1989 IEEE.

Improved Configuration Control for Redundant Robots, Journal of Robotic Systems 7 (6), 897–928 (1990) ©1990 by John Wiley & Sons, Inc.

Motion Control of 7–DOF Arms: The Configuration Control Approach, Homayoun Seraji, Mark K. Long and Thomas S. Lee, ©1993 IEEE.

Task–Based Configuration Control of Redundant Manipulators, Journal of Robotic Systems 9(3), 411–451 (1992) ©1992 by John Wiley & Sons, Inc.

Case Excavator 9010B, Form No. CE 020–11–95.

Case Loader/Backhoe 590 Super L, Form No. CE 019–7–96.

Case Construction Equipment, Form No. CE ALL–03–99.

Case Loader/Backhoes L Series 2, Form No. CE 175–01–98.

* cited by examiner

*Primary Examiner*—William A. Cuchlinski, Jr.
*Assistant Examiner*—Arthur D. Donnelly
(74) *Attorney, Agent, or Firm*—Foley & Lardner

(57) ABSTRACT

A control system for a backhoe apparatus is disclosed. Backhoe apparatus control system includes a kinematic optimal control including the augmentation of additional tasks that can be formulated into the optimal control problem. Further, the control system may include a dynamic adaptive control that accounts for the backhoe linkage dynamics. Still further, the control system is configured to control the flow of hydraulic fluid into and out of the hydraulic actuators.

49 Claims, 2 Drawing Sheets

UNIFIED CONTROL OF A WORK IMPLEMENT

FIELD OF THE INVENTION

The present invention generally relates to controlling a work implement. More particularly, the invention relates to a unified control system for controlling the motion of a work implement such as a bucket coupled to a work vehicle such as a backhoe or an excavator.

BACKGROUND OF THE INVENTION

A typical backhoe includes an elongated boom with a dipper stick assembly articulately connected to the distal end of the boom. A work implement such as a bucket, or the like, is connected to the distal end of the dipper stick assembly. The boom, the dipper stick assembly, and the work implement are relatively massive components that develop substantial inertia as they move from one position to another.

As will be appreciated by those skilled in the art, a cylinder end of each hydraulic cylinder is pivotally connected to the implement frame to allow pivotal movement of the drivers in response to movements of the backhoe apparatus to opposite sides of the implement or machine. As is conventional, each hydraulic cylinder has a piston rod that linearly extends from the cylinder end of the driver. The rod end of each cylinder is articulately connected to the swing tower as by a pin passing endwise through a weldment. The pins that connect the rod ends of the cylinders to the swing tower each extend along an axis that is parallel to the vertical swing axis of the swing tower.

The backhoe bucket is conventionally controlled by a set of operator controls. The typical operator controls provide either extension or retraction of hydraulic cylinders, or rotation of the joints connecting the backhoe members. Conventional backhoes are not configured to accept operator inputs that correspond to motions of the backhoe bucket in Cartesian space.

Traditional controls for backhoes typically only control the motions of the backhoe apparatus disregarding any constraints on the backhoe apparatus such as the avoidance of any obstacles, controlling the force applied by the backhoe apparatus, minimizing time to travel, minimizing gravity torque, preventing engine stall or backhoe tippage, or other user defined constraints. In traditional controls, such constraints are met only through the combination of skill and experience exhibited by the operator in manipulating the controls, thereby preventing operation by unskilled operators and causing erroneous operation by even skilled operators.

Many conventional backhoe controls do not control the flow of hydraulic fluid into the cylinder; rather, many conventional controls attempt to control the angular position of the backhoe apparatus joints. Also, many conventional controls do not include inertial parameters in the control design.

Conventional backhoe controls are not configured to account for the inertial parameters and forces on the backhoe members. Nor are conventional backhoe controls configured to provide hydraulic fluid flow control signals as opposed to angular rate or velocity signals. Furthermore, conventional backhoe controls are not configured to adapt to changes in available hydraulic fluid flow conditions, or changes in the linkage dynamics of the system.

Thus, there is a need and desire for a unified control for a work implement such as a bucket coupled to a work vehicle such as an excavator or a backhoe. There is also a need and desire for a unified control for a backhoe or excavator that controls the work implement tip position. There is also a need and desire for a unified control that accounts for predetermined constraints during control of the backhoe or excavator apparatus. Further still, there is a need and desire for a unified control that incorporates the positional control and constraints into the minimization of an objective criterion.

Further still, there is a need and desire for a unified control that accounts for inertial parameters and forces on the backhoe or excavator members. Further still, there is a need and desire for a unified backhoe or excavator control that provides hydraulic fluid flow control signals. Further still, there is a need and desire for a unified backhoe or excavator control that is configured to adapt to changes in available hydraulic fluid flow conditions, or changes in the linkage dynamics of the system.

SUMMARY OF THE INVENTION

The present invention relates to an apparatus for controlling a work implement. The apparatus includes a means for defining the posture of a work implement. The apparatus also includes a means for defining a unified vector, including the implement posture. Further, the apparatus includes a means for providing kinematic control signals for the implement posture. The kinematic control signal is provided by a kinematic controller configured to control a system that is any one of a redundant system, an exact system, and an overdetermined system.

The present invention also relates to a method for controlling a work implement for a work vehicle. The method includes defining the posture of the work implement. The method also includes defining a unified vector, the unified vector including a bucket posture. The method further includes defining a control objective, in terms of the unified vector. Further still, the method includes providing a kinematic control signal formulated to minimize the control objective, by applying a transformation that can be used on any one of a redundant system, an exact system, and an overdetermined system.

The present invention further relates to an apparatus for controlling a work implement for a work vehicle. The work implement includes a plurality of actuatable joints, actuatable by a plurality of hydraulic actuators. The apparatus includes a kinematic controller receiving a command signal representative of a command posture signal and a measured posture signal and providing a first output signal representative of the angular velocity of the joints of the work implement. The first output signal is generated based on the mathematical optimization of an objective criterion. The present invention still further relates to a flow controller receiving the first output signal from the kinematic controller and one of a signal representative of the actual flow and an estimated flow signal. The flow controller provides a signal representative of the stem displacement of the plurality of hydraulic actuators.

The present invention still further relates to an apparatus for controlling a work implement for a work vehicle. The work implement includes a plurality of actuatable joints, actuatable by a plurality of hydraulic actuators. The apparatus includes a kinematic controller receiving a command signal representative of a command posture signal and receiving a measured posture signal. The kinematic controller provides a first output signal representative of the angular velocity of the joints of the work implement. The first output signal is generated based on the mathematical optimization of an objective criterion. The apparatus also includes an adaptive controller for generating a cylinder force control signal.

Still further the present invention relates to a method for controlling a work implement. The work implement has n actuatable joints. The method includes defining an m-by-1 posture vector to represent bucket position and orientation with respect to a fixed Cartesian Coordinate System, defining a k-by-1 additional feature vector, and defining an objective criterion that is a function of the posture vector and the additional feature vector. The method also includes obtaining a desired n-by-1 joint angle velocity vector based on minimization of the object criterion.

BRIEF DESCRIPTION OF THE DRAWINGS

The invention will become more fully understood from the following detailed description, taken in conjunction with the accompanying drawings, wherein like reference numerals refer to like parts, in which.

DETAILED DESCRIPTION OF THE PREFERRED EMBODIMENTS

Figure 1:
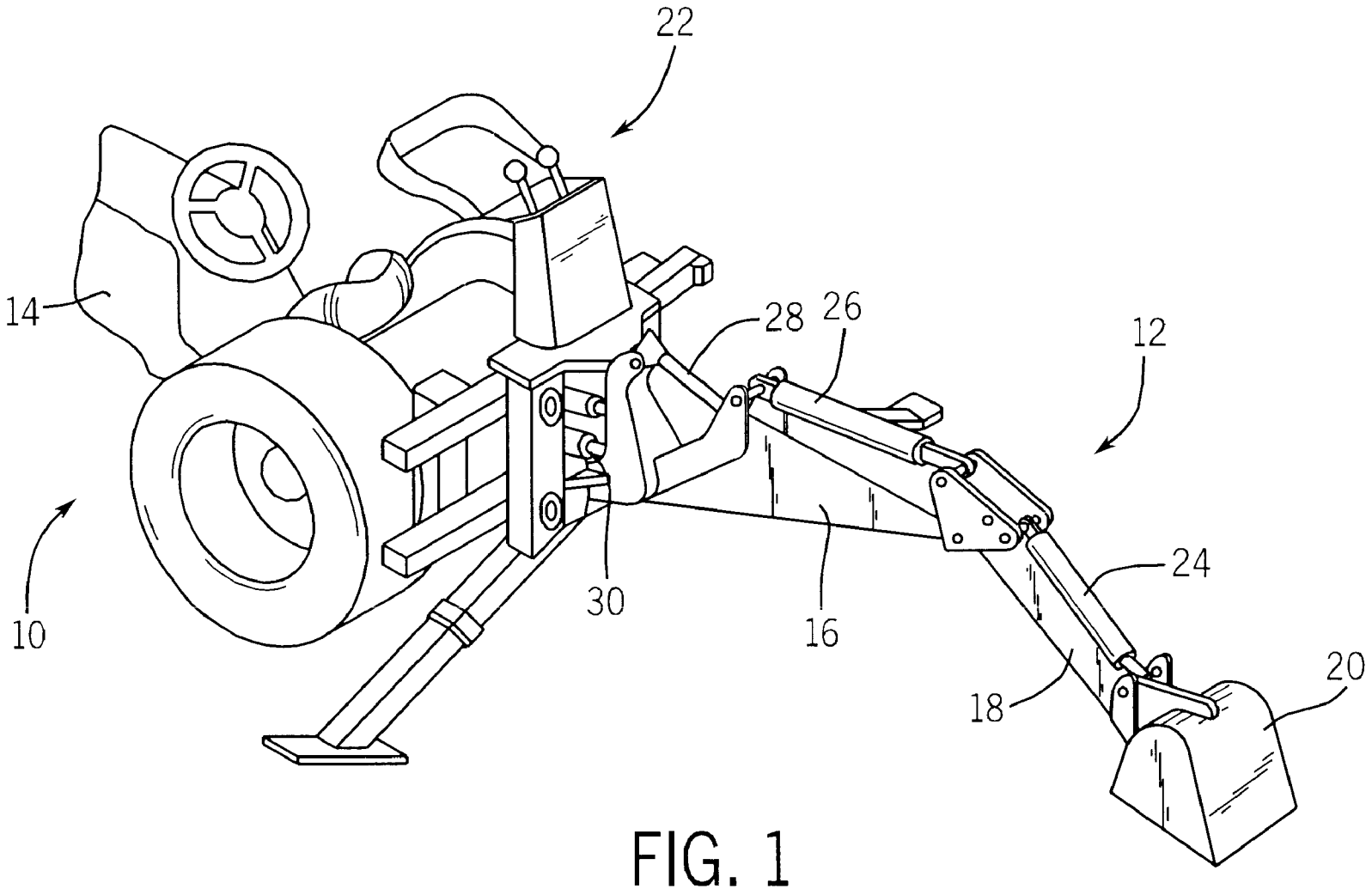
FIG. 1 is a fragmentary perspective view of an off-highway implement having a backhoe apparatus mounted thereto.

Referring to FIG. 1, there is depicted an off-highway work vehicle 10, having a backhoe apparatus 12, attached thereto. Implement 10 includes a fore-and-aft extending frame 14 that is suitably supported for movement across a field. Backhoe apparatus 12 typically includes a swinging boom 16, a dipper stick 18, and a work implement depicted as bucket 20. Movement of bucket 20 is controlled by a set of controls 22. Bucket 20 is moved by a hydraulic cylinder 24. Dipper stick 18 is moved by a hydraulic cylinder 26. Boom 16 is likewise moved by a hydraulic cylinder 28. The horizontal swinging action of boom 16 is controlled by a set of hydraulic cylinders 30.

In a preferred embodiment of the present invention, controls 22 control all of hydraulic cylinders 24, 26, 28, and 30. Further, controls 22 work in conjunction with unified controller electronics (to be discussed herein) to provide the desired movement of bucket 20.

Figure 2:
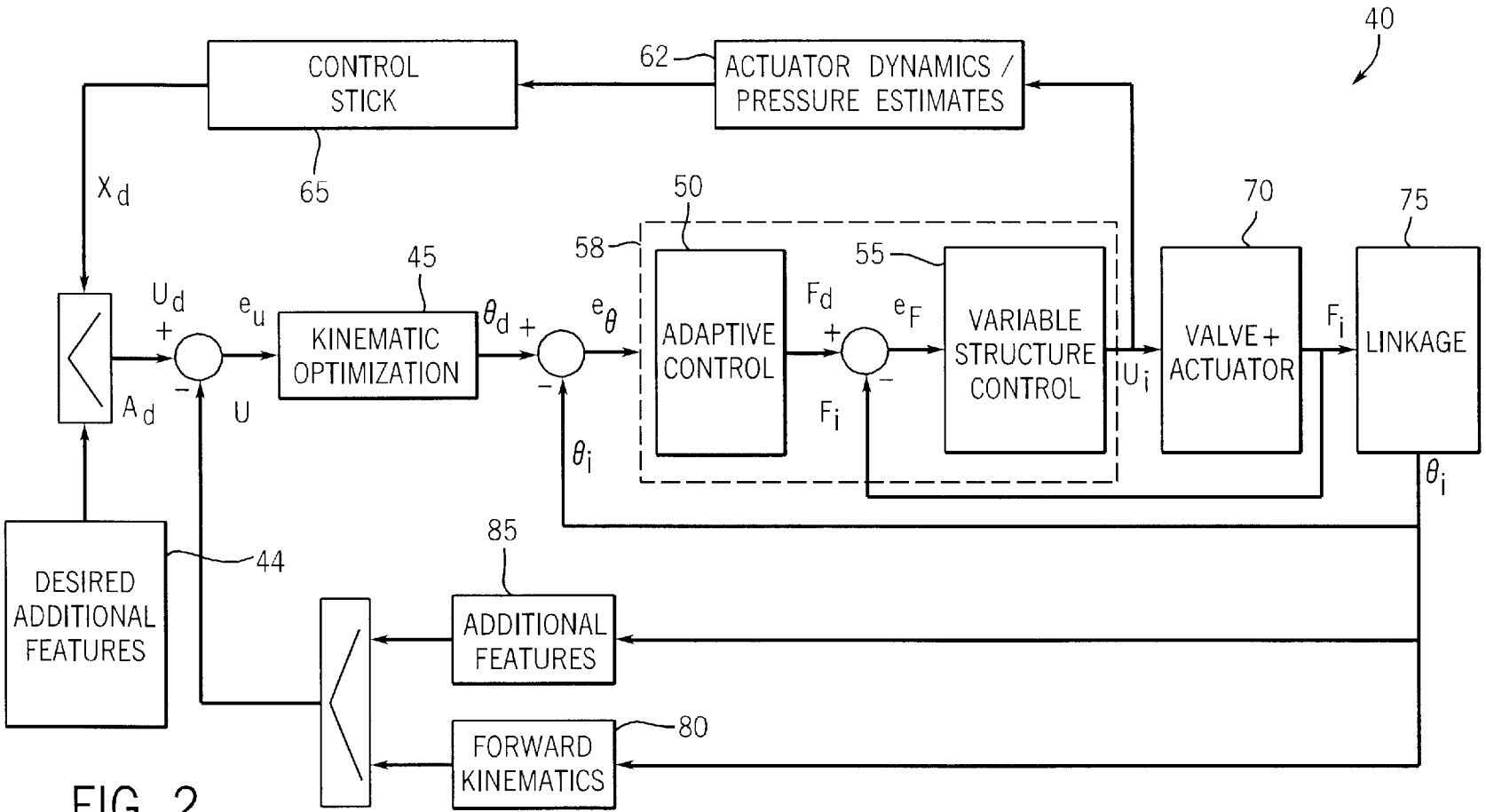
FIG. 2 is a block diagram of a kinematic and dynamic controller.

Referring now to FIG. 2, a unified controller 40 is depicted. Unified controller 40 includes a kinematic controller 45 and a dynamic controller 50. Unified controller 40 is adapted to control a backhoe or excavator such as backhoe apparatus 12, or the like. Backhoe apparatus 12 may be kinematically exact, redundant, or overdetermined. A backhoe or like apparatus is kinematically exact if the number of posture component (m) is equal to the number of moveable joints (n) that make up the backhoe or work implement. Thus, a backhoe is kinematically redundant if m<n, and a backhoe is kinematically overdetermined if m>n. When a backhoe arm is kinematically exact, control design is substantially simplified because there is only one set of joint movements that lead to a desired end effect. If a backhoe is kinematically overdetermined, some end effects may not be able to be achieved and therefore an optimization must be utilized to fit a best possible control in order to most closely achieve the desired end effect. If a backhoe arm is kinematically redundant, an infinite number of joint motions can lead to the same end effect (i.e., the solution to the control problem is not unique), therefore control design is decidedly more difficult because it is necessary to decide between a number of equivalent end effect objectives.

Because it is possible to design the hardware for a backhoe system that is kinematically exact, kinematically redundant, or kinematically overdetermined, it is beneficial to design a controller that can accommodate any of these situations so that the controller can easily be adapted thereto.

The present invention relates to a unified control system for a backhoe. The forward kinematic model for the backhoe can be represented as $$P_{m\times l}=f(\theta_{n\times l}) \tag{1}$$

where P=Posture vector (bucket position, preferably in Cartesian coordinates and bucket orientation) and θ=vector of joint angles (alternatively, the posture vector may include any representative state variables or transformed state variables, including but not limited to position, velocity, angular velocity, acceleration, angular acceleration, or linear and nonlinear combinations thereof).

The time derivative of the forward kinematic model may be represented as $$\dot{P}_{m\times l}=J_{P\ m\times n}(\theta)\dot{\theta}_{n\times l} \tag{2}$$

where $J_{P\ m\times n}(\theta)$=Jacobian matrix of the posture vector.

Additional features may be incorporated into the design of the controller, especially in machines having redundancies (e.g., some backhoe models include a linearly extended hole). Additional features can include obstacle avoidance, force control, and kinematic optimization. Machines without redundancies, may still be provided with the additional features of this control system design.

The additional features may be represented as $$A_{k\times l}=g(\theta_{n\times l}) \tag{3}$$

where A=Additional features vector and where k=the number of additional features.

The time derivative of the additional features is represented by $$\dot{A}_{k\times l}=J_{A_{k\times n}}(\theta)\dot{\theta}_{n\times l} \tag{4}$$

where $J_A$=Jacobian matrix of the additional features vector.

A unified vector may be defined as $$U_{(k+m)\times 1}=\begin{bmatrix} P_{m\times 1} \\ A_{k\times 1} \end{bmatrix}_{(m+k)\times 1}=h_{l\times 1}(\theta) \tag{5}$$

where U=Unified vector, and l=k+m.

The time derivative of the unified vector is given as $$\dot{U}_{l\times 1}=\begin{bmatrix} J_{P_{m\times m}} \\ J_{A_{k\times n}} \end{bmatrix}\dot{\theta}=J_{l\times n}(\theta)\dot{\theta}_{n\times 1} \tag{6}$$

where J(θ)=Unified Jacobian matrix.

An operator of backhoe 10 specifies a desired unified vector either by predetermining a number of constraints and/or by inputting control commands. In an alternative embodiment of the present invention the unified vector may be specified by an automated site planning and positioning system, that automatically controls the operations carried out at a work site without any, or with limited, operator interaction. The desired unified vector is defined as $$U_d = \begin{bmatrix} P_d \\ A_d \end{bmatrix} \tag{7}$$

where $P_d$=desired posture vector and $A_d$=desired additional feature vector.

The controller is configured to achieve $$U(t) \rightarrow U_d \tag{8}$$

in an optimal manner to satisfy both the desired posture and the desired additional feature.

1. Unified Kinematic Control

Referring again to FIG. 2, unified kinematic control 45 is formulated as an optimal control problem with a set of constraints. The unified kinematic control is formulated as $$\text{Min}\Phi = \dot{E}^T W \dot{E} + \lambda E_Q^2, \tag{9}$$

where $\lambda$ is a constraint weighting factor such that $\lambda=0$ if $E_Q \leqq 0$ and $\lambda>0$ if $E_Q>0$ (or there is insufficient available flow from the hydraulic pump system mounted on vehicle 10, which includes both a small pump and a large pump, discussed in detail later), and in an exemplary embodiment having three controlled hydraulic cylinders (alternatively, any number of cylinders could be controlled), $$E = U_d - U, \tag{10}$$

$$E_Q = (Q_1 + Q_2 + Q_3 - Q_{S1} - Q_{S2}), \tag{1}$$

$$W = \text{Weighting factor}, \tag{12}$$

$$Q_1 = K_1 \dot{\theta}_1 = \text{Boom cylinder flow}, \tag{13}$$

$$Q_2 = K_2 \dot{\theta}_2 = \text{Dipper stick cylinder flow}, \tag{14}$$

$$Q_3 = K_3 \dot{\theta}_3 = \text{Bucket cylinder flow}, \tag{15}$$

$$Q_{S1} = \text{small pump flow, and} \tag{16}$$

$$Q_{S2} = \text{large pump flow.} \tag{17}$$

An objective of the unified kinematic control is to find the angular rate hence the cylinder flow that minimizes the objective function $\Phi$. To do this, an expression for the derivative of the objective function $\Phi$ with respect to the angular rates is $$\frac{\partial \Phi}{\partial \dot{\theta}} = {}^{-}2J^T W \dot{U}_d + 2J^T W J \dot{\theta} + 2K\dot{\theta} - 2S \tag{18}$$

setting $$\frac{\partial \Phi}{\partial \dot{\theta}} = 0 \tag{19}$$

and solving for $\dot{\theta}_d$, an expression for $\dot{\theta}_d$ may be derived as $$\dot{\theta}_d = [J^T W J + K]^{-1} [J^T W \dot{U}_d + S], \tag{20}$$

and may be augmented as $$\dot{\theta}_d = [J^T W J + K]^{-1} [J^T W (\dot{U} + K_e E) + S \tag{21}$$

where the $K_e E$ term has been added to avoid the steady state error E. Further, $$K = \lambda \begin{bmatrix} K_1^2 & K_1 K_2 & K_1 K_3 \\ K_1 K_2 & K_2^2 & K_2 K_3 \\ K_1 K_3 & K_2 K_3 & K_3^2 \end{bmatrix} \tag{22}$$

= matrix of cylinder flow conversion factors and $$S = \lambda [Q_{S1} + Q_{S2}] \begin{bmatrix} K_1 \\ K_2 \\ K_3 \end{bmatrix}. \tag{23}$$

As the desired angular rates ($\dot{\theta}_{id}$) are calculated, the flow rates may be calculated therefrom, as $$Q_{id} = K_i \dot{\theta}_{id}, \tag{24}$$

when i=1 , . . . , n, to provide the desired flow rates for each cylinder. The advantage of using an optimal kinematic control as provided above is that both trajectory and flow constraints are satisfied by some optimal combination of the trajectory and flow constraints. Further, additional features (represented by reference numeral 85 in FIG. 2) may be specified which are added as constraints in the unified kinematic control.

For example, a posture control may be specified as an additional feature 85. A posture control may be configured to maintain a constant bucket angle to achieve a desired slope of a dig. For example, if a desired angle for the slope is 45°, one would specify in the desired additional features 44, $$A_d(t) = 45° \tag{25}$$

where $A(t)=\theta_3$ and $\theta_3$ is the bucket angle. Alternatively, any joint angle or function representative of slope may be specified in a similar manner.

Another additional feature 85 that may be specified may be obstacle avoidance. Obstacle avoidance may be used to provide an avoidance zone near the cab or it may be used to provide an avoidance zone where there is limited space for maneuvering the backhoe. The avoidance zone may be defined as $$S(\theta) \geqq C \tag{26}$$

such that if $S(\theta) \geqq C$ the constraint is ignored. If $S(\theta)<C$ the constraint is active and $S(\theta)$ is set equal to C. Thus, additional feature 85 is defined as $$A = S(\theta) \tag{27}$$

with desired additional feature 44, $$A_d = C. \tag{28}$$

A further additional feature 85 that may be specified is force control. Force control may be used when a uniform hardness on the excavation surface is required, or a specific slope compaction is required. To fulfill this objective, a constant force (F) is maintained and the joint torque needed to produce F is minimized. The joint torque may be defined as $$T = J_p^T(\theta) F. \tag{29}$$

The objective then is to minimize the joint torque by minimizing an objective criterion $\Phi_T$ where $$\Phi_T=\|T\|_W^2=T^TWT. \quad (30)$$

The time derivative of $\Phi_T$ is $$\frac{d\Phi_T}{dt}=H^T\frac{\partial\Phi_T}{\partial\theta}, \quad (31)$$

so to minimize $\Phi_T$ with respect to time, it is desirable to drive $$\frac{d\Phi_T}{dt}$$

to 0 so desired additional feature 44, $A_d(\theta)=0$ and $$A(\theta)=H^T\frac{\partial\Phi_T}{\partial\theta} \quad (32)$$

where $$J_pH=0. \quad (33)$$

A further additional feature 85 that may be specified is carry with load which provides a trajectory requiring a minimum time to travel while providing a minimum gravity torque due to the payload. This minimization may be formulated generally as $$\text{Min}\Phi_G=G^T(\theta)WG(\theta) \quad (34)$$

where $G(\theta)$=Gravity Torque. So, similar to force control, to minimize $\Phi_G$ with respect to time, it is desirable to drive $$\frac{d\Phi_G}{dt}$$

to 0 so $A_d(\theta)=0$ (provided in desired additional features 44) and $$A(t)=H^T\frac{\partial\Phi}{\partial\theta}. \quad (35)$$

This additional carry with load feature helps to reduce the amount of stress on the backhoe vehicle joints.

Further still, an additional feature 85 that may be added to the backhoe control is a normal digging feature. A normal digging feature ensures that the engine does not stall due to overload and that the excavator/backhoe (vehicle) does not tip due to weight overloading. The additional feature is defined as $$A(t)=0 \text{ if } F_{max}-F\geqq 0 \text{ and} \quad (36)$$

$$A(t)=F_{max}-F \text{ if } F_{max}-F<0 \quad (37)$$

where, $$F_{max}=\min(F_{max_1}, F_{max_2})*K, \quad (38)$$

such that $F_{max_1}$ is the force that causes the engine to stall;

$F_{max_2}$ is the force that causes the backhoe/excavator to tip; and

K is a safety factor less than 1.

The objective is to obtain $A_d(t)=0$ provided by desired additional features 44. Alternatively, the engine overload and the anti-tipping features could be formulated as separate features.

Further, any other additional features 85 may be specified using the general formulation $$\text{Min } \psi(\theta) \quad (39)$$

where $$A(t)=H^T\frac{\partial\psi}{\partial\theta},$$

$J_pH=0$, with the desired additional feature 44, $A_d=0$.

For example, joint angular velocity or tip velocity may be minimized, however the additional features are not limited to any of those features disclosed above nor are the formulations for the additional features limited to those provided above. It is well known to those of ordinary skill in the art to formulate the objective criterion in numerous ways.

2. Unified Dynamic Control

Once the kinematic control has supplied a signal representative of the flow necessary in each cylinder, the actuator effects and linkage dynamics are taken into account in unified dynamic controller 50 (which may be an adaptive controller). In a preferred embodiment, dynamic controller 50 is a model reference adaptive control utilizing a model of the linkage dynamics. The linkage dynamics may be represented as $$[J(\theta)+J_c(\theta)]\ddot{\theta}+H\dot{\theta}+[C(\theta,\dot{\theta})+C_c(\theta,\dot{\theta})]\dot{\theta} \quad (40)$$
$$+G(\theta)-N(\theta)F=0$$

where $J(\theta)$=the inertia matrix for the linkages.

$J_c(\theta)$=the actuator affects on the linkage inertias

H=the linkage friction matrix $C(\theta,\dot{\theta})$=the linkage Coriolis matrix $C_c(\theta,\dot{\theta})$=the actuator effect on the linkage Coriolis matrix $G(\theta)$=the gravity effect $N(\theta)$=the force to torque conversion matrix $\theta=[\theta_1\ \theta_2\ \theta_3\ \theta_4]^T$=the joint angles $F=[F_1\ F_2\ F_3\ F_4]^T$=the cylinder force vector where $F_1=P_{i1}A_{i1}-P_{i2}A_{i2}$ and $P_{i1}$=pressure in the with cylinder at the head end $P_{i2}$=pressure in the with cylinder at the rod end $A_{i1}$=cross sectional area of the cylinder at the head end $A_{i2}$=cross sectional area of the cylinder at the rod end.

The actuator dynamics may be given as the set of differential equations $$\dot{P}_{11}=K_1\dot{y}_1+K_2Q_{11} \quad (41)$$

$$\dot{P}_{12}=K_3\dot{y}_1+K_4Q_{12} \quad (42)$$

$$\dot{P}_{21}=K_5\dot{y}_2+K_6Q_{21} \quad (43)$$

$$\dot{P}_{22}=K_7\dot{y}_2+K_8Q_{22} \quad (44)$$

$$\dot{P}_{31}=K_9\dot{y}_3+K_{10}Q_{31} \quad (45)$$

$$\dot{P}_{32}=K_{11}\dot{y}_3+K_{12}Q_{32} \quad (46)$$

$$\dot{P}_{41}=K_{13}\dot{y}_4+K_{14}Q_{41} \quad (47)$$

$$\dot{P}_{42}=K_{15}\dot{y}_4+K_{16}Q_{42} \quad (48)$$

where $\dot{y}_i$=the cylinder velocity;

$K_j$=the cylinder coefficient; and $Q_{ij}$=the flow in cylinder i at the j end (j=1=head end, j=2=rod end).

Standard hydraulic equations for hydraulic cylinders may be given as $$Q_{i1} = A_{i1}(u_i)C_d\sqrt{\frac{2(P_s - P_{i1})}{\rho}} - A_{i2}(u_i)C_d\sqrt{\frac{2P_{i1}}{\rho}} \tag{49}$$

$$Q_{i2} = A_{i3}(u_i)C_d\sqrt{\frac{2P_{i2}}{\rho}} - A_{i4}(u_i)C_d\sqrt{\frac{2(P_s - P_{i2})}{\rho}} \tag{50}$$

where $u_i$=the stem displacement for cylinder i $C_d$=a fluid property constant;

ρ=the flow density; and $P_s$=the supply pressure.

In a preferred embodiment of the invention, the unified kinematic control 45 is configured to generate the desired joint angle $\theta_d$ that will meet flow control requirements. Thus, based on the measured joint angle $\theta_a$ and the desired joint angle $\theta_d$, unified dynamic controller 50 (adaptive controller) is utilized to generate a desired cylinder force $F_d$ to guarantee that U is driven to $U_d$ under different conditions, such as payload changes, etc.

In one embodiment of the present invention, both head end and rod end pressures are measured in each cylinder (represented as valve+actuator block) 70. Based on both of these measured pressures, the actual cylinder force $F_a$ can be calculated as described above. A variable structure controller 55 is then used to generate the spool displacement based on the cylinder force errors ($e_F$) the spool displacement command $u_i$ causes cylinder 70 to move, thereby producing a force ($F_i$) on linkage 75.

In an alternative embodiment, only one pressure is measured for each cylinder 70 along with one supply pressure. Based on the desired cylinder force $F_{d_i}$ and pressure $P_{i1}$, pressure $P_{i2}$ can be calculated. Thus, having $P_{i1}$ and $P_{i2}$, the desired flow rates $Q_{i1}$ and $Q_{i2}$, the spool displacement for each cylinder can be calculated.

Once the unified kinematic control 45 generates desired angular velocities or flow rates for each cylinder, a flow controller 58 can be used to force the actual flow rate to follow the desired flow rate, for simplicity. A closed loop controller such as this has one shortcoming however, that is that the operator loses the normal feeling of ground conditions in the control mechanisms. Thus, in order to provide an operator with a feeling of ground conditions, spool displacement ($u_i$) can be used as an input to the actuator dynamics pressure estimator 62 to estimate the cylinder pressures. The estimated cylinder pressures can then be used to provide physical or visual indications to the operator, such as by providing force feedback in control stick 65, regarding the ground conditions.

As linkage 75 moves, the angular displacement of each link is measured and is communicated to forward kinematics 80 and additional features 85 to calculate the current unified vector (U), for feedback to kinematic controller 45.

3. Practical Constraints and Adaptive Gain Scheduling

In a preferred embodiment of the present invention, cylinder velocity constraints can be added to the kinematic optimal control loop, such that the kinematic control is formulated as $$\text{Min } \Phi = \dot{E}^T W \dot{E} + \lambda E_Q^2 + \sum_{i=1}^{4} \lambda_i (V_i - V_{i_{\max}})^2 \tag{51}$$

where $V_i$=the measured cylinder velocity and $V_{i_{max}}$=the maximum cylinder velocity. Thus, the term $$\sum_{i=1}^{4} \lambda_i (V_i - V_{i_{\max}})^2 \tag{52}$$

is the cylinder velocity constraint. Solving for the desired joint angular velocity $\dot{\theta}_d$, $$\dot{\theta}_d = [J^T WJ + K + K_\lambda]^{-1}[J^T W(\dot{U}_d + K_e E) + S + S_\lambda], \tag{53}$$

with $$K_\lambda = \begin{bmatrix} \lambda_1 a_1^2 & 0 & 0 & 0 \\ 0 & \lambda_2 a_2^2 & 0 & 0 \\ 0 & 0 & \lambda_3 a_3^2 & 0 \\ 0 & 0 & 0 & \lambda_4 a_4^2 \end{bmatrix}, \tag{54}$$

and $$S_\lambda = \begin{bmatrix} \lambda_1 a_1 V_{1\max} \\ \lambda_2 a_2 V_{2\max} \\ \lambda_3 a_3 V_{3\max} \\ \lambda_4 a_4 V_{4\max} \end{bmatrix} \tag{55}$$

where $V_i = a_i \dot{\theta}_1$, $a_i$=conversion factor from joint velocities to cylinder linear velocities, and $$J = \text{augmented Jacobian matrix} = \left[\frac{J_p}{J_A}\right].$$

Also in a preferred embodiment, the feedback gain $K_e$ can be gain scheduled to reduce oscillation. Defining the bucket error as $$E_b = \sqrt{(x_{ref} - x_a)^2 + (y_{ref} - y_a)^2 + (z_{ref} - z_a)^2} \tag{56}$$

an exemplary gain schedule may be given as $$K_e = \begin{cases} K_{eo} & \text{if} \quad E_b \geq b_1 \\ f_{ke} & \text{if} \quad b_2 < E_b < b_1 \\ 0 & \text{if} \quad E_b \leq b_2 \end{cases} \tag{57}$$

where $b_1 > b_2$ and $f_{ke}$ is a smooth transition function that connects $K_{eo}$ with 0. An exemplary choice for $f_{ke}$ is $$f_{ke} = K_{eo}\left[1 - \text{Sin}\frac{\pi}{2}E_b - \frac{b_1}{b_2 - b_1}\right]. \tag{58}$$

Alternatively a B-spline curve that connects two endpoints $K_{eo}$ at $E_b = b_1$ and 0 at $E_b = b_2$ by $f_{ke} = d_3 t^3 + d_2 t^2 + d_1 t + d_0$.

The weighting factor λ may also be gain scheduled such that $$\lambda = \begin{cases} \lambda_0 & \text{if} \quad E_Q \geq b_{1\lambda} \\ f_{k\lambda} & \text{if} \quad b_{2\lambda} < E_Q < b_{1\lambda} \\ 0 & \text{if} \quad E_Q \leq b_{2\lambda} \end{cases} \tag{59}$$

where $f_{k\lambda}$ is preferably a smooth function that connects $\lambda_0$ with 0. An exemplary choice for $f_{k\lambda}$ is $$f_{k\lambda} = \frac{\lambda_0}{2}\left[1 + \text{Cos}\pi E_Q - \frac{b_{1\lambda}}{b_{2\lambda} - b_{1\lambda}}\right]. \tag{60}$$

Alternatively a b-spline curve could be applied.

It is also advantageous to gain schedule the values of $K_1$ thru $K_4$. An exemplary gain schedule is $$K_i = l_i * [0*(|\dot{\theta}_i| < b_{ik}) + 1*(\dot{\theta}_i > b_{ik}) - 1*(\dot{\theta}_i < -b_{ik})] \quad i=1, \ldots, 4 \tag{61}$$

Thus, the value of $K_i$ equals one of $l_i$,0,$-l_i$. The values of $b_{ik}$ are preferably chosen by simulation or experiment.

Further still, it is beneficial to gain schedule the weighting matrix of the additional task. The weighting matrix may be $$W = \begin{bmatrix} W_b & 0 \\ 0 & W_a \end{bmatrix} \tag{62}$$

where $W_b$=weighting matrix of basic task=$W_{b0}*I_{n\times n}$, and $W_a$=weighting matrix of additional task=$W_{a0}*I_{r\times r}$ with n=no. of basic tasks and r=no. of additional tasks. Therefore, $$w_{ao} = \begin{cases} 0 & \text{if} \quad E_b > b_{w1} \\ f_w & \text{if} \quad b_{w1} < E_b < b_{w2} \\ w_{bo} & \text{if} \quad E_2 > b_{w2} \end{cases} \tag{63}$$

with $b_{w1} > b_{w2}$.

An exemplary choice of function $f_w$ is a smooth function that connects zero with $w_{bo}$. One choice is $$f_w = w_{b_0}\left[1 - \sin\frac{\pi}{2}E_b - \frac{b_{w2}}{b_{w1} - b_{w2}}\right]. \tag{64}$$

Another choice would be to build a b-spline curve that connects the two end points 0 at $b_{w1}$ and $w_{b0}$ at $b_{w2}$.

When there is a conflict between flow control (k), the desired velocity vector ($\dot{X}_d$) and error vector E, or a conflict between basic task and additional task, the generated velocity vector $\dot{\theta}_d$ may violate the flow constraint occasionally. In such a situation it is desirable, in a preferred embodiment, to increase the value of $\lambda$ until the flow constraint is satisfied. This may be accomplished through a heuristic approach provided as (1) Initialize $\lambda_0$ (2) Calculate $\dot{\theta}_d = [J^T WJ + K]^{-1}[J^T W(\dot{x}_d + K_e E) + S]$ (1) Initialize $\lambda_0$ (2) Calculate $\dot{\theta}_d = [J^T WJ + K]^{-1}[J^T W(\dot{x}_d + K_e E) + S]$ (3) If $[Q_{1d} + Q_{2d} + Q_{3d} + Q_{4d} - (Q_{s1} + Q_{s2})] > E_{qo}$ Then increase $\lambda_0$ (e.g., by 5%)

Goto (2)

-continued

Else $Q_T = Q_{1d} + Q_{2d} + Q_{3d} + Q_{4d}$ if $[Q_T > (Q_{s1} + Q_{s2})]$ then $S_f = \dfrac{Q_{s1} + Q_{s2}}{Q_T}$ else $S_f = 1$ end if End if (4) $\dot{\theta}_d = \dot{\theta}_d * S_f$ This set of adaptive heuristics aids in solving oscillation problems and performance problems introduced by the unified kinematic control.

In a preferred embodiment of the present invention, a low level control loop may be implemented to adapt to hydraulic actuator delay and to adapt to actuator nonlinearities. A low level control loop may be of the type including, but not limited to Smith predictor or internal mode control. Further, a nonlinear transformer or other applicable control technique may be applied to adapt to actuator nonlinearities.

The control described above may be applied to a variety of work vehicles including, but not limited to, loaders, backhoes, loader/backhoes, skid-steers, and any vehicles or work implements having controlled joint movements.

While the detailed drawings, specific examples, and particular formulations given describe preferred embodiments of the present invention, they serve the purpose of illustration only. For example, the control methodologies, algorithms, and mathematical models of physical systems may differ depending on chosen control characteristics and the physical characteristics of the work vehicle or implement. The apparatus of the invention is not limited to the precise details and conditions disclosed. Furthermore, other substitutions, modifications, changes, and omissions may be made in the design, operating conditions, and arrangement of the preferred embodiments without departing from the spirit of the invention as expressed in the appended claims.

What is claimed is:

1. An apparatus for controlling a work implement, the apparatus comprising:

means for defining the posture of a work implement;

means for defining a unified vector, including the implement posture; and means for providing kinematic control signals for the implement posture, the kinematic control signals being provided by a kinematic controller configured to control a system that is any one of a redundant system, an exact system, and an overdetermined system.

2. The apparatus of claim 1, wherein the means for defining the posture includes means for defining the posture in Cartesian coordinates.

3. The apparatus of claim 1 wherein the means for defining a unified vector includes means for defining an additional features vector.

4. The apparatus of claim 1 wherein the means for providing kinematic control signals includes means for minimizing an objective criterion to generate the kinematic control signals.

5. The apparatus of claim 1 further comprising:

means for providing desired force control signals.

6. The apparatus of claim 5 wherein the means for providing desired force control signals includes an adaptive controller.

7. The apparatus of claim 1 further comprising a variable structure control for providing control signals representative of actuator displacements.

8. The apparatus of claim 1 further comprising:

means for gain scheduling.

9. The apparatus of claim 8 wherein the means for gain scheduling includes means for adjusting a set of posture vector feedback gains.

10. The apparatus of claim 8 wherein the means for gain scheduling includes gain scheduling a set of weighting matrix values.

11. The apparatus of claim 1 further comprising:

adaptive heuristics means for improving controller performance characteristics.

12. A method for controlling a work implement for a work vehicle, the method comprising:

defining the posture of the work implement;

defining a unified vector, the unified vector including a bucket posture;

defining a control objective, in terms of the unified vector; and providing a kinematic control signal formulated to minimize the control objective, by applying a transformation that can be used on any one of a redundant system, an exact system, and an overdetermined system.

13. The method of claim 12 wherein the work implement includes a plurality of actuatable joints that move in response to the motion of a hydraulic cylinder.

14. The method of claim 13 further comprising:

adding hydraulic cylinder velocity constraints to the objective criterion.

15. The method of claim 13 further comprising:

generating a desired actuatable joint force using an adaptive controller.

16. The method of claim 13 wherein each of the actuatable joints move in response to the motion of a hydraulic cylinder and further comprising:

generating hydraulic cylinder spool displacements using a variable structure controller.

17. The method of claim 12 further comprising:

providing estimated force feedback, the estimated force feedback being representative of the force on the work implement.

18. The method of claim 12 further comprising:

providing a set of posture vector feedback gains.

19. The method of claim 18 further comprising:

gain scheduling the posture vector feedback gains.

20. The method of claim 12 further comprising:

providing a weighting matrix for the objective criterion.

21. The method of claim 20 further comprising:

gain scheduling the weighting matrix values.

22. The method of claim 21 further comprising:

providing adaptive heuristics to improve controller performance.

23. The method of claim 12 wherein the kinematic control signals are limited by the total hydraulic fluid flow.

24. The method of claim 12 further comprising:

adding available hydraulic fluid flow constraints to the objective criterion.

25. An apparatus for controlling a work implement for a work vehicle, the work implement including a plurality of actuatable joints, actuatable by a plurality of hydraulic actuators, the apparatus comprising:

a kinematic controller receiving a command signal representative of a command posture signal and a measured posture signal and providing a first output signal representative of the angular velocity of the joints of the work implement, the first output signal being generated based on the mathematical optimization of an objective criterion; and a flow controller receiving the first output signal from the kinematic controller and one of a signal representative of the actual flow and an estimated flow signal, the flow controller providing a signal representative of the stem displacement of the plurality of hydraulic actuators.

26. The apparatus of claim 25 wherein the kinematic controller is configured to control a system that is any one of a redundant system, an exact system, and an overdetermined system.

27. The apparatus of claim 25 wherein the objective criterion includes hydraulic cylinder velocity constraints.

28. The apparatus of claim 25 further comprising an adaptive controller for providing desired hydraulic actuator forces.

29. The apparatus of claim 28 wherein the adaptive controller adapts to actuator delay.

30. The apparatus of claim 28 wherein the adaptive controller adapts to actuator nonlinearity.

31. The apparatus of claim 25 wherein the flow controller signal is limited by the total hydraulic fluid flow.

32. The method of claim 25 wherein the available hydraulic fluid flow is added as a constraint to the objective criterion.

33. An apparatus for controlling a work implement for a work vehicle, the work implement including a plurality of actuatable joints, actuatable by a plurality of hydraulic actuators, the apparatus comprising:

a kinematic controller receiving a command signal representative of a command posture signal and receiving a measured posture signal, the kinematic controller providing a first output signal representative of the angular velocity of the joints of the work implement, the first output signal being generated based on the mathematical optimization of an objective criterion; and an adaptive controller for generating a cylinder force control signal.

34. The apparatus of claim 33 further comprising:

a variable structure control for generating a spool displacement control signal, based on a cylinder force error signal generated from the cylinder force control signal and a measured cylinder force signal.

35. The apparatus of claim 34 wherein the cylinder force is the kinematic control signal providing kinematic control signals for the posture of a bucket, the kinematic controller adapted to control a system that is any one of a redundant system, an exact system, and an overdetermined system, the kinematic controller at least providing control signals corresponding to trajectory following.

36. The apparatus of claim 33 further comprising:

a delay control loop for adapting to actuator delay.

37. The apparatus of claim 33 further comprising:

a nonlinear transformer for adapting to hydraulic nonlinearity.

38. The apparatus of claim 33 further comprising:

a gain scheduler configured to adapt controller parameters.

39. A method for controlling a work implement, the work implement having m posture vector components and having n actuatable joints, the method comprising:

defining an m-by-1 posture vector;

defining a k-by-1 additional feature vector;

defining an objective criterion that is a function of the posture vector and the additional feature vector; and obtaining a desired m-by-1 joint angle velocity vector based on minimization of the objective criterion.

40. The method of claim 39 wherein each of the actuatable joints move in response to motion of a hydraulic cylinder and further comprising:

adding hydraulic cylinder velocity constraints to the objective criterion.

41. The method of claim 39 further comprising:

generating a desired actuatable joint force using an adaptive controller.

42. The method of claim 39 wherein each of the actuatable joints move in response to motion of a hydraulic cylinder and further comprising:

generating hydraulic cylinder spool displacements using a variable structure controller.

43. The method of claim 39 further comprising:

providing estimated force feedback, the estimated force feedback being representative of the force on the work implement.

44. The method of claim 39 further comprising:

providing a set of posture vector feedback gains.

45. The method of claim 44 further comprising:

gain scheduling the posture vector feedback gains.

46. The method of claim 39 further comprising:

providing a weighting matrix for the objective criterion.

47. The method of claim 46 further comprising:

gain scheduling the weighting matrix values.

48. The method of claim 39 further comprising:

providing adaptive heuristics to improve controller performance.

49. The method of claim 39 further comprising:

adding available hydraulic fluid flow constraints to the objective criterion.

* * * * *